US008021244B2

(12) United States Patent
Kato

(10) Patent No.: US 8,021,244 B2
(45) Date of Patent: Sep. 20, 2011

(54) GOLF CLUB SHAFT

(75) Inventor: Masatoshi Kato, Hyogo (JP)

(73) Assignee: SRI Sports Limited, Kobe (JP)

( * ) Notice: Subject to any disclaimer, the term of this patent is extended or adjusted under 35 U.S.C. 154(b) by 177 days.

(21) Appl. No.: 12/496,321

(22) Filed: Jul. 1, 2009

(65) Prior Publication Data

US 2010/0022324 A1 Jan. 28, 2010

(30) Foreign Application Priority Data

Jul. 24, 2008 (JP) ..... 2008-190598

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS 5,427,373 A * 6/1995 Kusumoto ..... 473/319

FOREIGN PATENT DOCUMENTS

| | | | |
|---|---|---|---|
| JP | 08089605 A | * | 4/1996 |
| JP | 11-206932 A | | 8/1999 |
| JP | 2002177423 A | * | 6/2002 |
| JP | 2003102883 A | * | 4/2003 |
| JP | 2003-169871 A | | 6/2003 |
| JP | 2004008345 A | * | 1/2004 |
| JP | 2005-034550 A | | 2/2005 |

* cited by examiner

*Primary Examiner* — Stephen L. Blau
(74) *Attorney, Agent, or Firm* — Birch, Stewart, Kolasch & Birch, LLP

(57) ABSTRACT

A shaft 6, which is a tubular body, includes a laminate of fiber reinforced resin layers. This fiber reinforced resin layer includes a matrix resin and a fiber. When a portion with a minimum thickness in the entire shaft is defined as a thinnest part, the entire thinnest part exists in a range of a first position to a second position. The first position is a position where an axial distance from a tip of the shaft is 50% of a full length of the shaft. The second position is a position where the axial distance from the tip of the shaft is 75% of the full length of the shaft. In this shaft 6, a flexural rigidity value EIc ($N/m^2$) of the shaft at a point which is 175 mm away from a rear end of the shaft is two times or greater and three times or less of a flexural rigidity value EIm ($N/m^2$) of the thinnest part.

16 Claims, 11 Drawing Sheets

GOLF CLUB SHAFT

The present application claims priorities on Japanese Patent Application No. 2008-190598 filed on Jul. 24, 2008. The whole contents of the Japanese Patent Application are hereby incorporated by reference.

BACKGROUND OF THE INVENTION

1. Field of the Invention

The present invention relates to a golf club shaft.

2. Description of the Related Art

A golf club shaft flexes during a swing. In particular, in the early stage of a downswing, the flexure of the shaft is caused by the inertia of a head. The shaft flexes so as that the head delays relative to the travel direction of the downswing in the early stage of the downswing. The angular acceleration of the shaft decreases gradually from the downswing to the impact to release the flexure of the shaft. This release of the flexure accelerates the speed of the head to obtain a large flight distance.

The shaft has a flexural rigidity distribution. The flexural rigidity distribution influences the flexure during the swing. The flexural rigidity distribution influences the behavior of the shaft during the swing.

A flex point (flex point ratio) has been known as an index showing the characteristics of the flexural rigidity of the shaft. A shaft having a tip side that easily forms a flexure is generally referred to as low flex point. A shaft having a rear end side that easily forms a flexure is generally referred to as high flex point. The referred low flex point or high flex point has been known in the market as the index showing the characteristics of the shaft. However, the standards of the low flex point and high flex point are not necessarily unified among the persons skilled in the art. The current situation is that a plurality of standards for the flex point exist.

Examples of the inventions relating to the flexural rigidity distribution of the shaft include Japanese Unexamined Patent Application Publication No. 2003-169871, Japanese Unexamined Patent Application Publication No. 2005-34550 and Japanese Unexamined Patent Application Publication No. 11-206932.

SUMMARY OF THE INVENTION

The present inventor has examined the flexural rigidity distribution of the shaft based on a technical idea different from the conventional technique. The behavior of the shaft during the swing has been examined. As a result, the flexural rigidity distribution of the shaft was found to have a room for the improvement. The shaft of the present invention was found to tend to obtain a large flexure amount and to tend to release the flexure. This shaft tends to obtain a large flexure and to release this flexure. The release of the large flexure accelerates a head speed. This shaft tends to obtain a large head speed. The large head speed contributes to the increase in a flight distance.

The insufficient release of the flexure is apt to deteriorate the directivity of hit balls. When the release of the flexure is insufficient, a face of the shaft is apt to be opened at impact. Since the shaft of the present invention tends to release the flexure, the shaft can improve the directivity of the hit ball.

It is an object of the present invention to provide a golf club shaft which tends to obtain a large flexure and release the flexure.

A shaft according to the present invention, which is a tubular body, includes a laminate of fiber reinforced resin layers. The fiber reinforced resin layer includes a matrix resin and a fiber. When a portion with a minimum thickness in the entire shaft is defined as a thinnest part, the entire thinnest part exists in a range of a first position to a second position. The first position is a position where an axial distance from a tip of the shaft is 50% of a full length of the shaft. The second position is a position where the axial distance from the tip of the shaft is 75% of the full length of the shaft. A flexural rigidity value EIc ($N/m^2$) of the shaft at a point which is 175 mm from a rear end of the shaft is two times or greater and three times or less of a flexural rigidity value EIm ($N/m^2$) of the thinnest part.

A flex point ratio C1 of the shaft defined by the following formula is preferably equal to or less than 47%, $$C1=[F2/(F1+F2)]\times 100$$

wherein F1 is forward flex (mm), and F2 is backward flex (mm).

The shaft is preferably subjected to surface polishing. When a polishing amount (mm) in a portion where the polishing amount is minimum in the entire shaft is defined as Ks and a polishing amount (mm) in the thinnest part is defined as Km, the polishing amount Km is preferably larger than the polishing amount Ks.

A thickness Tm of the thinnest part is preferably 0.6 mm or greater and 1.5 mm or less.

The flexural rigidity value EIm of the thinnest part is preferably 30 ($N\cdot m^2$) or greater and 60 ($N\cdot m^2$) or less.

DESCRIPTION OF THE PREFERRED EMBODIMENTS

Hereinafter, the present invention will be described in detail according to the preferred embodiments with appropriate references to the accompanying drawings.

In the present application, an "axial direction" means the axial direction of a shaft.

Figure 1:
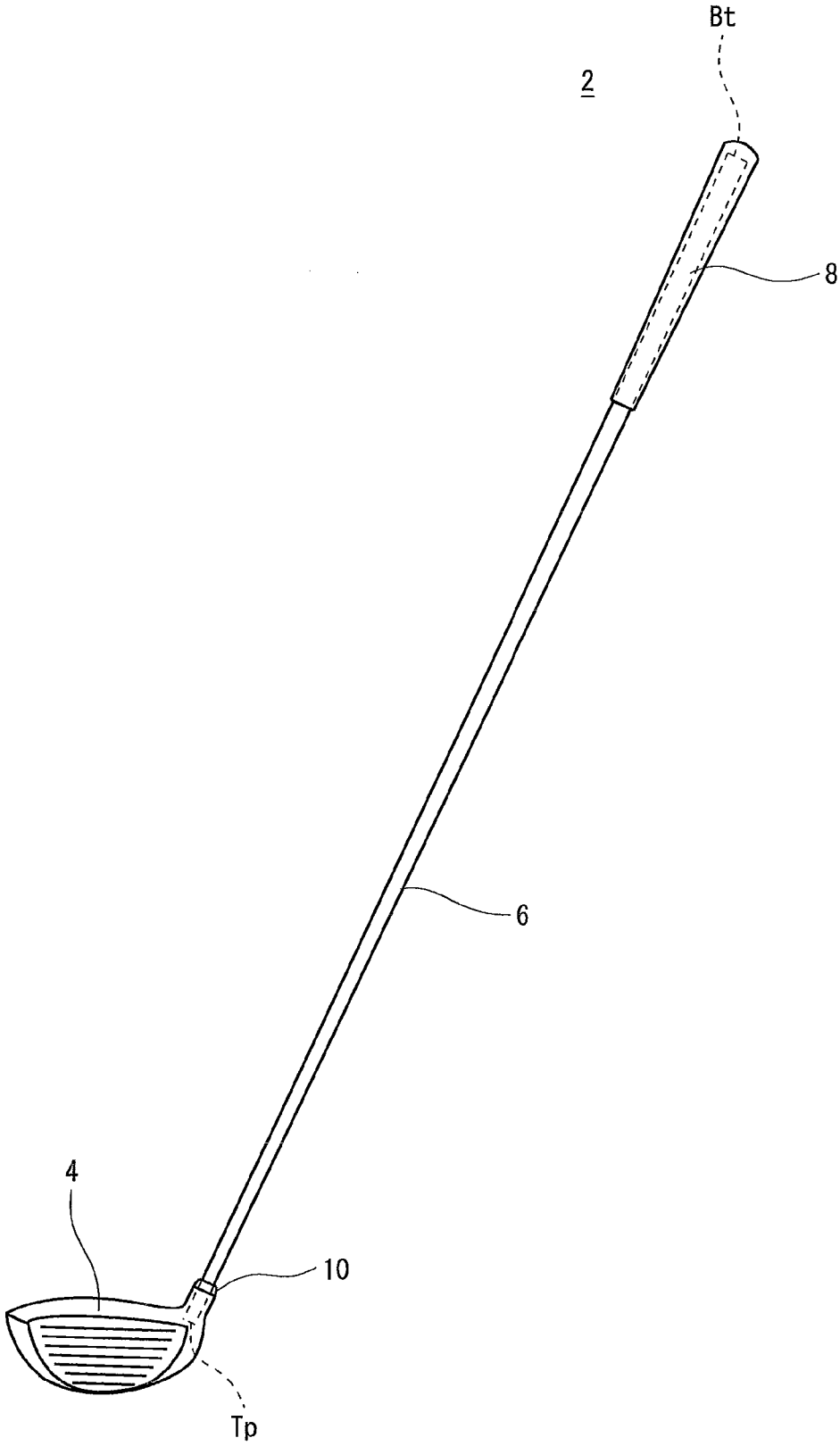
FIG. 1 is the whole view of a golf club to which a shaft according to one embodiment of the present invention is mounted.
Figure 2:
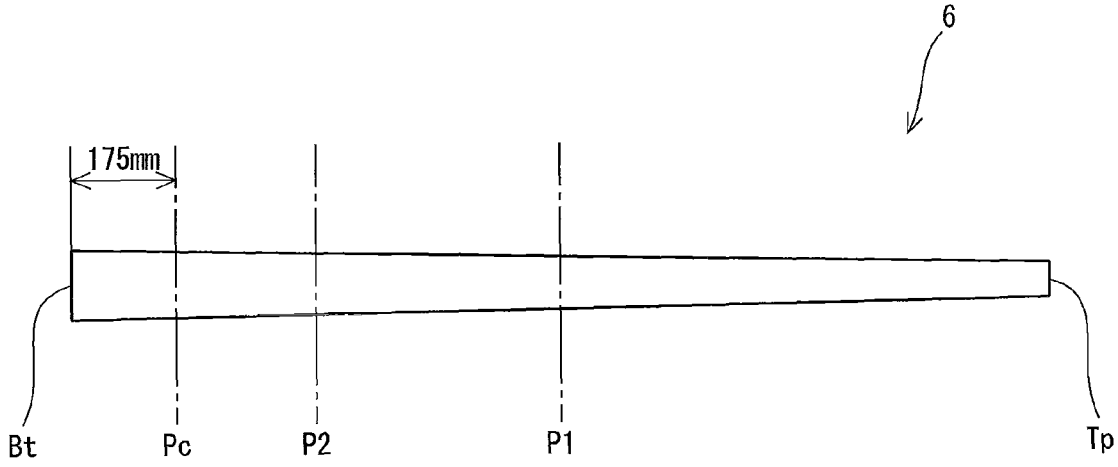
FIG. 2 shows a shaft according to one embodiment of the present invention.

As shown in FIGS. 1 and 2, a golf club 2 is provided with a head 4, a shaft 6, a grip 8 and a ferrule 10. The head 4 is a wood type golf club head. The head 4 is provided at the tip part of the shaft 6. The grip 8 is provided at the rear end part of the shaft 6. The head 4 has a hollow structure which is not shown. The head 4 is made of a titanium alloy. The head 4 and grip 8 mounted to the shaft 6 are not limited. As the head 4, the wood type golf club head, an iron type golf club head and a putter head or the like are exemplified.

The shaft 6 includes a laminate of fiber reinforced resin layers. The shaft 6 is a tubular body. The shaft 6 has a hollow structure which is not shown. As shown in FIG. 1, the shaft 6 has a tip (tip end) Tp and a rear end (butt end) Bt. The tip Tp is located inside the head 4. The rear end Bt is located inside the grip 8.

The shaft 6 is a so-called carbon shaft. The shaft 6 is preferably produced by curing a prepreg sheet. In this prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven. This prepreg sheet has a fiber and a matrix resin. This fiber is typically a carbon fiber. This matrix resin is typically a thermosetting resin.

The shaft 6 is preferably produced by so-called a sheet winding method. In a state of the prepreg, the matrix resin is in a semicured state. The shaft 6 is produced by winding and curing the prepreg sheet. This curing means the curing of the semicured matrix resin. This curing is attained by heating. The producing process of the shaft 6 includes a heating process. This heating process cures the matrix resin of the prepreg sheet.

The shaft 6 can be also produced without using the prepreg sheet. A filament winding method is exemplified as another process of the shaft 6.

Figure 3:
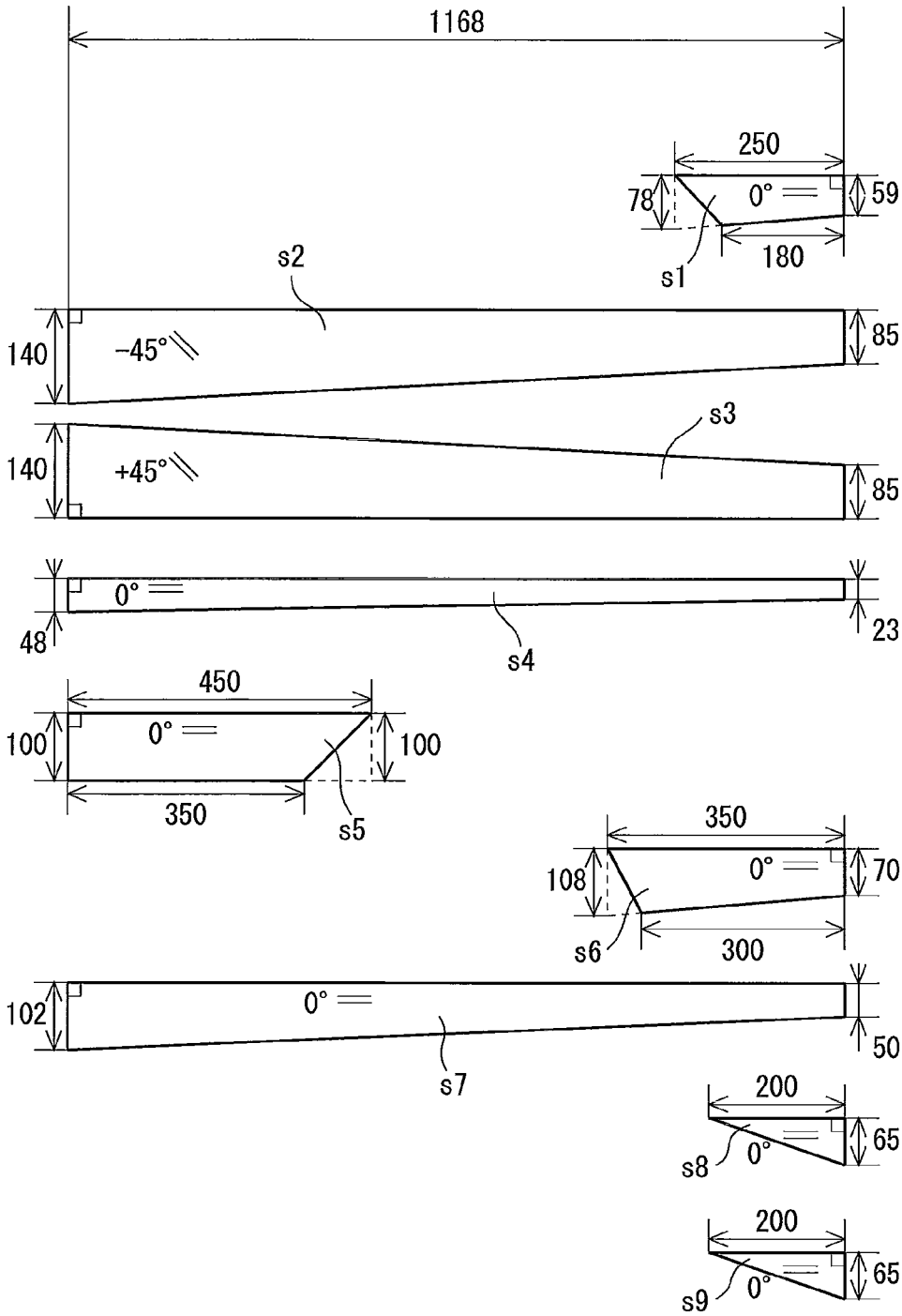
FIG. 3 is a developed view of a shaft of Example 1.

FIG. 3 is a developed view (sheet constitution view) of the prepreg sheets constituting the shaft 6 according to one embodiment of the present invention. FIG. 3 doubles as a developed view of a shaft of Example 1 to be described later. The shaft 6 includes a plurality of sheets. Specifically, the shaft 6 includes nine sheets s1 to s9. In the present application, the developed view shown in FIG. 3 or the like shows the sheets constituting the shaft in order from the radial inner side of the shaft. The sheets are wound around a mandrel in order from the sheets located above in the developed view. In the developed view of FIG. 3 or the like, the horizontal direction of the figure agrees with the axial direction of the shaft. In the developed view of FIG. 3 or the like, the right side of the figure is the tip end Tp side of the shaft. In the developed view of FIG. 3 or the like, the left side of the figure is the butt end Bt side of the shaft.

The developed view of FIG. 3 or the like shows not only the winding order of each of the sheets but also the arrangement of each of the sheets in the axial direction of the shaft. For example, one end of the sheet s1 is located at the tip end Tp. For example, the other end of the sheet s5 is located at the butt end Bt.

The shaft 6 has a straight layer and a bias layer. The orientation angle of the fiber is described in the developed view of FIG. 3 or the like. A sheet described as "0 degree" constitutes the straight layer. The sheet for the straight layer is also referred to as a straight sheet in the present application. Sheets described as "−45 degrees" and "+45 degrees" constitute the bias layer. The sheet for the bias layer is also referred to as a bias sheet in the present application.

A straight layer is a layer in which the orientation direction of the fiber is substantially made parallel to the axial direction of the shaft. The incompletely parallel orientation direction of the fiber to the axial direction of the shaft is usually caused by error or the like in winding. In the straight layer, an angle Af between the orientation direction of the fiber and the axial direction of the shaft is about −10 degrees or greater and about +10 degrees or less. In the shaft 6, the straight sheets are the sheet s1, the sheet s4, the sheet s5, the sheet s6, the sheet s7, the sheet s8 and the sheet s9. The straight layer is highly correlated with the flexural rigidity and flexural strength of the shaft.

The bias layer is provided in order to enhance the torsional rigidity and torsional strength of the shaft. The bias layer includes at least two sheets in which the orientation directions of the fibers are inclined in opposite directions to each other. The bias layer includes a layer having the angle Af of −65 degrees or greater and −25 degrees or less and a layer having the angle Af of 25 degrees or greater and 65 degrees or less. In the shaft 6, the sheets constituting the bias layer are the sheet s2 and the sheet s3. The plus (+) and minus (−) in the angle Af show that the fibers of the sheets for the bias layer are inclined in opposite directions to each other.

In the embodiment of FIG. 3, the angle of the sheet s2 is −45 degrees and the angle of the sheet s3 is +45 degrees. It should be appreciated, however, that the angle of the sheet s2 may be +45 degrees and the angle of the sheet s3 may be −45 degrees.

Layers other than the straight layer and the bias layer may be provided. For example, a hoop layer may be provided. In the hoop layer, the orientation direction of the fiber is substantially made perpendicular to the axial line of the shaft. The hoop layer is provided in order to enhance the crushing rigidity and crushing strength of the shaft. The crushing rigidity is rigidity to a force crushing the shaft toward the inner side in the radial direction thereof. The crushing strength is strength to a force crushing the shaft toward the inner side in the radial direction thereof. The crushing strength can be also involved with the flexural strength. The crushing strength can be interlocked with flexural deformation to generate crushing deformation. In a particularly thin lightweight shaft, this interlocking property is large. The enhancement of the crushing strength also causes the enhancement of the flexural strength. The hoop layer is a layer in which the orientation direction of the fiber is substantially made perpendicular to the axial direction of the shaft. In other words, the hoop layer is a layer in which the orientation direction is substantially made parallel to the circumferential direction of the shaft. The incompletely perpendicular orientation direction of the fiber to the axial direction of the shaft is usually caused by error or the like in winding. In the hoop layer, the angle Af is usually 90 degrees ±10 degrees. The hoop layer is not provided in the shaft 6 of this embodiment.

Hereinafter, the prepreg sheets s1 to s9 used for producing the shaft 6 will be described. The prepreg sheet before being used is sandwiched between release sheets (not shown). The release sheets are a mold release paper and a resin film. The prepreg sheet before being used is sandwiched between the mold release paper and the resin film. That is, the mold release paper is stuck on one surface of the prepreg sheet, and the resin film is stuck on the other surface of the prepreg sheet. Hereinafter, the surface on which the mold release paper is stuck is also referred to as "a surface of a mold release paper side", and the surface on which the resin film is stuck is also referred to as "a surface of a film side".

Figure 4:
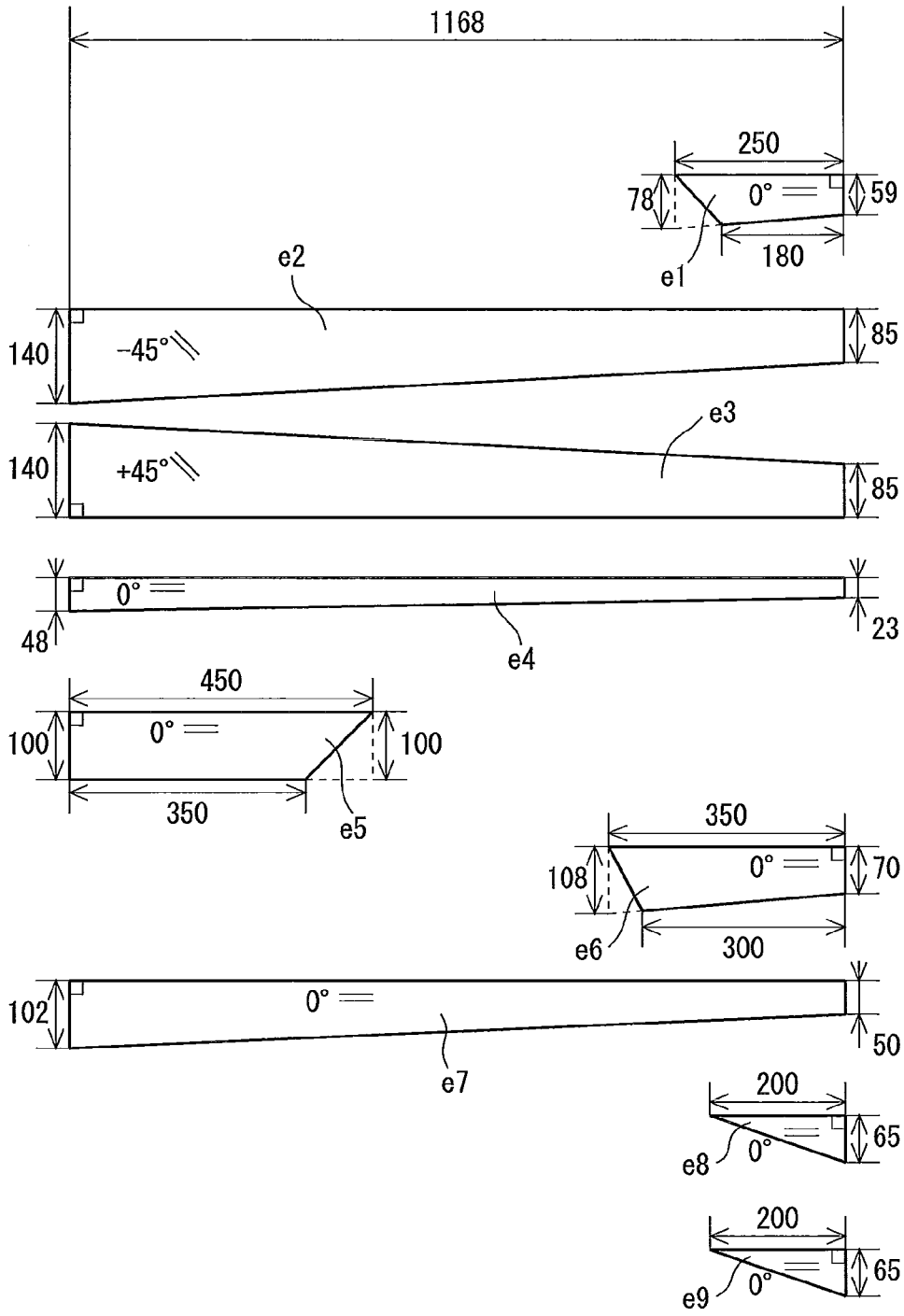
FIG. 4 is a developed view of a shaft of Example 2 and a shaft of Comparative Example 3.
Figure 5:
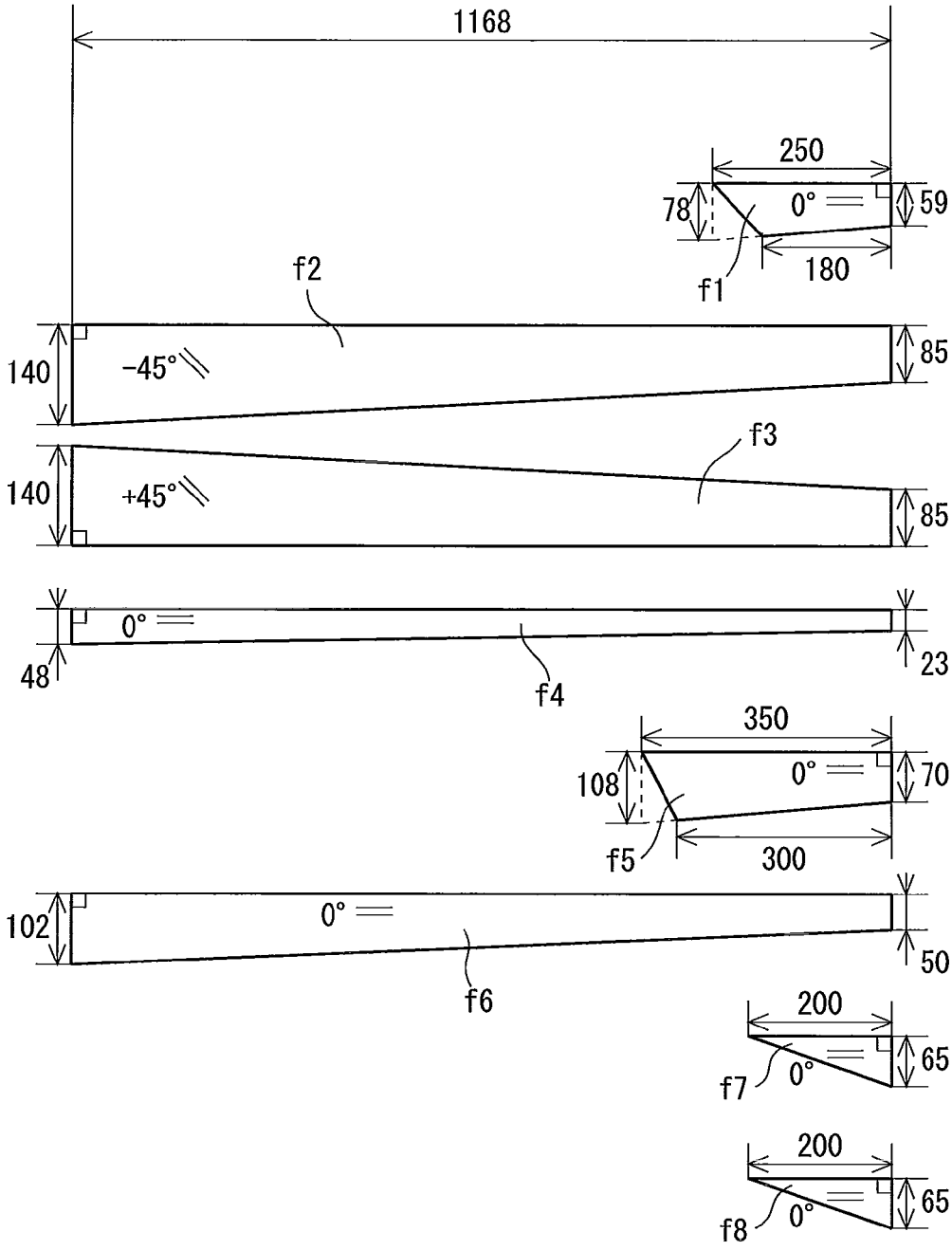
FIG. 5 is a developed view of a shaft of Comparative Example 4.
Figure 6:
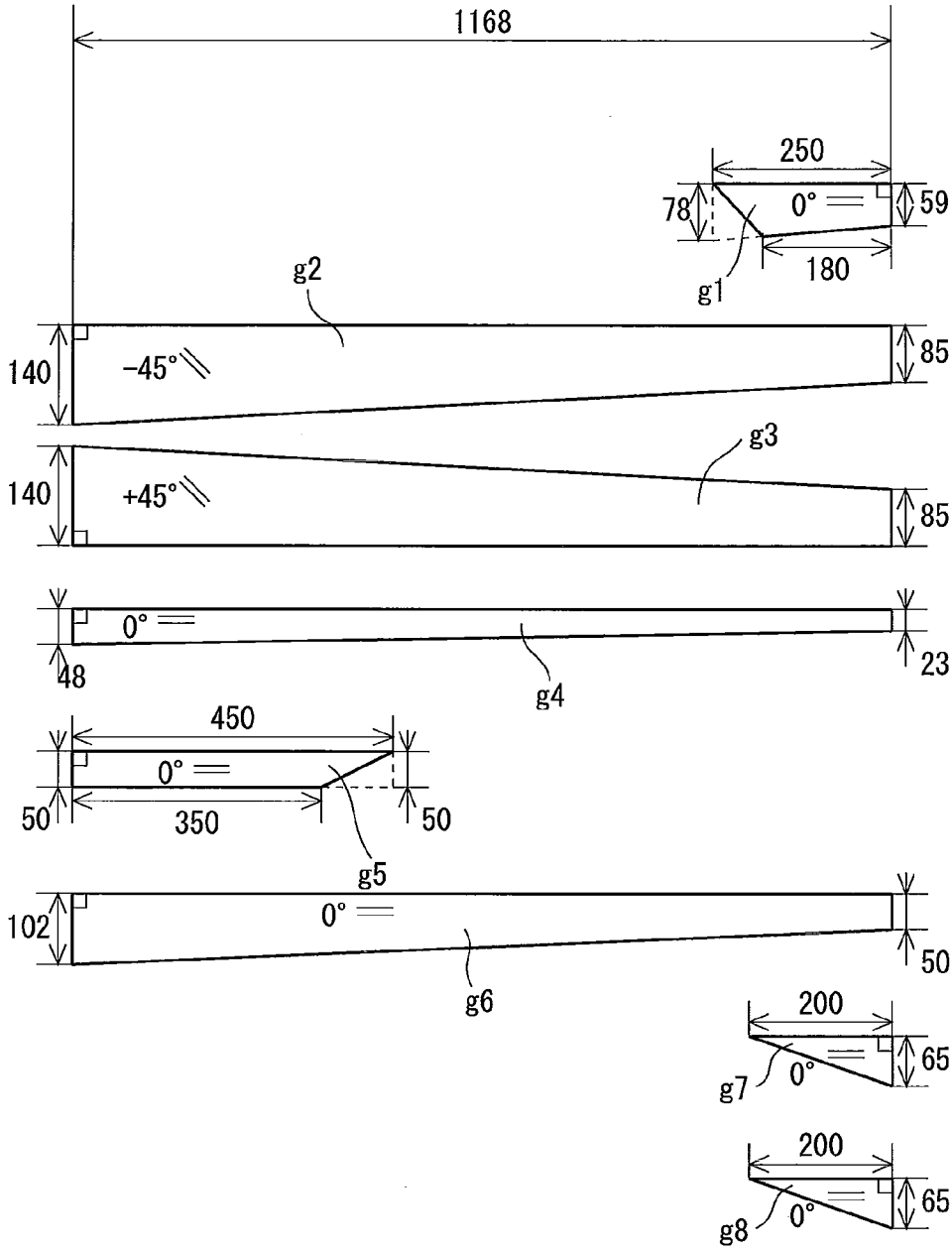
FIG. 6 is a developed view of a shaft of Comparative Example 5.

In the developed view of FIG. 3, the surface of the film side is the front side. That is, in the developed view of FIG. 3 or the like, the front side of the figure is the surface of the film side, and the back side of the figure is the surface of the mold release paper side. In the state of FIG. 3, the fibrous direction (orientation) of the sheet s2 is the same as that of the sheet s3. However, in the case of the laminating to be described later, the sheet s3 is reversed, and thereby the fibrous directions of the sheets s2 and s3 are opposite to each other. In light of this point, in FIG. 3, the fibrous direction of the sheet s2 is described as "−45 degrees", and the fibrous direction of the sheet s3 is described as "+45 degrees". FIGS. 4, 5 and 6 are also described as in FIG. 3.

Hereinafter, a method for producing the shaft 6 will be schematically described. This producing method includes the following processes (1) to (9).

(1) Cutting Process

The prepreg sheet is cut into a desired shape in the cutting process. A full length sheet and a partial sheet are produced by this cutting. Thus, the shaft 6 includes the full length sheet and the partial sheet. The full length sheet is provided over the axial direction of the shaft. In the embodiment of FIG. 3, the full length sheets are the sheet s2, the sheet s3, the sheet s4, and the sheet s7. The partial sheet is partially provided in the axial direction of the shaft. In the embodiment of FIG. 3, the partial sheets are the sheet s1, the sheet s5, the sheet s6, the sheet s8 and the sheet s9. The partial sheet includes a tip sheet and a rear end sheet. The tip sheet is disposed at a position including the tip. The rear end sheet is disposed at a position including the rear end. The tip sheets are the sheet s1, the sheet s6, the sheet s8 and the sheet s9. The rear end sheet is the sheet s5. The cutting may be performed by a cutting machine, or may be manually performed using a cutter knife or the like.

(2) Laminating Process

Sheets for the bias layer are laminated together in the laminating process. The laminating process may be performed after the cutting process. As described later, the laminating process can be performed before the cutting process. The laminating process is usually performed after the cutting process.

(3) Winding Process

The cut sheet is wound around the mandrel in the winding process. A winding body is obtained by the winding process. This winding body is obtained by wrapping the prepreg sheet around the outside of the mandrel. This winding process includes a process of removing a resin film, a process of sticking a winding starting edge part of a surface of the film side on a winding object, a process of removing a mold release paper after sticking the winding starting edge part, and a process of rotating the winding object to wind the prepreg sheet with the resin film and the mold release paper removed. The winding starting edge part is an edge part of a side in the longitudinal direction of the shaft. The winding object is rotated by rolling the winding object on a flat plate. The winding object may be rotated by a manual operation or a machine referred to as a rolling machine or the like.

(4) Tape Wrapping Process

A tape is wrapped around the outer peripheral surface of the winding body in the tape wrapping process. This tape is also referred to as a wrapping tape. This wrapping tape is wrapped while tension is applied to the wrapping tape.

(5) Curing Process

In the curing process, the winding body after performing the tape wrapping is heated. This heating cures the matrix resin. In this curing process, the matrix resin fluidizes temporarily. This fluidization of the matrix resin can discharge air between the sheets or in the sheet. The tension (clamp pressure force) of the wrapping tape accelerates this discharge of the air. This curing provides a cured laminate.

(6) Process of Extracting Mandrel and Process of Removing Wrapping Tape

The process of extracting the mandrel and the process of removing the wrapping tape are performed. The order of the both processes is not limited. However, the process of removing the wrapping tape is preferably performed after the process of extracting the mandrel in light of enhancing the efficiency of the process of removing the wrapping tape.

(7) Process of Cutting Both Ends The both end parts of the cured laminate are cut in this process. This cutting forms the tip end Tp and the butt end Bt of the shaft. This cutting flattens the end face of the tip end Tp and the end face of the butt end Bt.

(8) Polishing Process

The surface of the cured laminate is polished in this process. This polishing is also referred to as surface polishing. Spiral unevenness left behind as the trace of the wrapping tape exists on the surface of the cured laminate. The polishing extinguishes the unevenness as the trace of the wrapping tape to flatten the surface of the cured laminate. As described later, this polishing process can adjust the thickness distribution of the shaft. The polishing amount may be uniform in the entire shaft. The polishing amount may be different depending on the longitudinal position of the shaft. As described later, the polishing amount is preferably nonuniform in the present invention.

(9) Coating Process

The cured laminate after the polishing process is subjected to coating.

In the present application, a portion with a minimum thickness in the entire shaft is referred to as a thinnest part. The entire thinnest part exists in a range of a first position P1 to a second position P2. The first position P1 and the second position P2 are positions in the longitudinal direction of the shaft.

The first position P1 is a position where an axial distance from a tip Tp of the shaft is 50% of a full length of the shaft. The second position P2 is a position where the axial distance from the tip Tp of the shaft is 75% of the full length of the shaft.

The axial length of the thinnest part is not limited. The thinnest part may be at only one position in the axial direction of the shaft. In this case, the axial length of the thinnest part is close to about 0 mm. On the other hand, the thinnest part may have a range in the axial direction of the shaft. For example, the axial length of the thinnest part may be 10 mm. In this case, the entire thinnest part having a length of 10 mm needs to be located in the range of the first position P1 to the second position P2.

In the thinnest part, the shaft tends to flex. The existence of the thinnest part can increase the flexure of the shaft. The shortening of the axial length of the thinnest part facilitates the reduction of the rigidity of the thinnest part and the enhancement of the rigidity of the portion of the rear end relative to the thinnest part. This constitution tends to combine the large flexure and the easy release of the flexure. From this viewpoint, the axial length of the thinnest part is preferably equal to or less than 50 mm, more preferably equal to or less than 30 mm, and still more preferably equal to or less than 10 mm.

The shaft which largely flexes and easily releases the flexure tends to accelerate the head speed. The large head speed can increase the flight distance. The impact of the golf ball with the flexure incompletely released can cause the reduction of the head speed. When the flexure is incompletely released at impact, the face of the head is in an opened state at impact, and slice is apt to occur. On the other hand, when the golf ball is impacted with the flexure excessively released and the head preceding, the face is in a closed state at impact, and hook is apt to occur. By appropriately setting the position of the thinnest part, the flexure can be increased, and the release of the flexure can be made appropriate.

The thickness of the shaft is determined by, for example, the following factors (a) to (d). The factors (a) to (d) can be set depending on the longitudinal positions of the shaft. The position of a thin part can be adjusted by adjusting these factors. As described later, the thickness of the shaft is preferably adjusted depending on the polishing amount.

(a) The total thickness of the laminated materials (prepregs)

(b) The clamp pressure of the wrapping tape (c) The amount of the resin flowing out in the curing process (d) The polishing amount in the polishing process When the thinnest part has the axial length, the flexural rigidity value of the thinnest part may not be fixed. In this case, the flexural rigidity value EIm ($N/m^2$) is defined as the minimum value of the flexural rigidity value of the thinnest part.

A flex point ratio C1 of the shaft defined by the following formula is preferably set to equal to or less than 47%, $$C1=[F2/(F1+F2)]\times 100$$

wherein F1 is forward flex (mm), and F2 is backward flex (mm).

Methods for measuring the forward flex F1 and the backward flex F2 will be described later.

This shaft is preferably subjected to surface polishing. As described above, this surface polishing is performed in the polishing process. In a preferred embodiment, the polishing amount is made different depending on the axial position of the shaft. In this case, the position of the thinnest part can be adjusted depending on the polishing amount. The polishing amount means a thickness scraped away by polishing.

A polishing amount (mm) in a portion where the polishing amount is minimum in the entire shaft is defined as Ks. In other words, the polishing amount Ks is the minimum of the polishing amount in the shaft. On the other hand, the polishing amount (mm) in the thinnest part is defined as Km. At this time, the polishing amount Km is preferably made larger than the polishing amount Ks. By making the polishing amount uneven as described above, the adjustment of the position of the thinnest part can be facilitated to enhance the productivity. In the present application, this polishing amount Ks is also referred to as a minimum polishing amount.

In light of facilitating the position adjustment of the thinnest part, the difference (Km−Ks) is preferably equal to or greater than 0.01 mm, more preferably equal to or greater than 0.02 mm, and still more preferably equal to or greater than 0.03 mm. In light of relieving stress concentration to the thinnest part to enhance the strength of the shaft, the difference (Km−Ks) is preferably equal to or less than 0.1 mm, more preferably equal to or less than 0.08 mm, and still more preferably equal to or less than 0.07 mm.

In light of the smoothness of the surface, the polishing amount Ks is preferably equal to or greater than 0.01 mm, more preferably equal to or greater than 0.02 mm, and still more preferably equal to or greater than 0.03 mm. In light of the effective use of the material, the polishing amount Ks is preferably equal to or less than 0.08 mm, more preferably equal to or less than 0.06 mm, and still more preferably equal to or less than 0.05 mm.

In light of facilitating the position adjustment of the thinnest part, the polishing amount Km is preferably equal to or greater than 0.02 mm, more preferably equal to or greater than 0.04 mm, and still more preferably equal to or greater than 0.05 mm. In light of the strength of the shaft, the polishing amount Km is preferably equal to or less than 0.13 mm, more preferably equal to or less than 0.10 mm, and still more preferably equal to or less than 0.08 mm.

In light of the strength of the shaft, the thickness Tm (mm) of the thinnest part is preferably equal to or greater than 0.6 mm, and more preferably equal to or greater than 0.7 mm. In light of increasing the flexure caused by the flexing of the thinnest part and of the weight of the shaft, the thickness Tm is preferably equal to or less than 1.5 mm, and more preferably equal to or less than 1.3 mm.

The thickness of the shaft at a point which is 175 mm from the rear end of the shaft is referred to as a thickness Tc (mm). In light of the strength of the shaft, the thickness Tc is preferably 0.6 mm or greater and more preferably 0.7 mm or greater. In light of suppressing the weight of the shaft, the thickness Tc is preferably 2.3 mm or less, and more preferably 2.0 mm or less.

In light of facilitating the release of the flexure, a ratio [Tc/Tm] is preferably greater than 1.00, more preferably equal to or greater than 1.05, and still more preferably equal to or greater than 1.1. In light of suppressing the excessive release of the flexure, the ratio [Tc/Tm] is preferably equal to or less than 1.5, more preferably equal to or less than 1.4, and still more preferably equal to or less than 1.3.

A flexural rigidity value EIc at a point PC which is 175 mm from the rear end of the shaft and a flexural rigidity value EIm of the thinnest part are preferably considered in the present invention. The value EIc ($N/m^2$) is preferably two times or greater and three times or less of the value EIm ($N/m^2$). That is, a ratio [EIc/EIm] is preferably 2 or greater and 3 or less. The flexural rigidity value is measured by a method described later.

In light of suppressing the impact in a state where the flexure is incompletely released, the ratio [EIc/EIm] is preferably equal to or greater than 2. In light of suppressing the excessive release of the flexure, the ratio [EIc/EIm] is preferably equal to or less than 3, more preferably equal to or less than 2.8, and still more preferably equal to or less than 2.5.

The ratio [EIc/EIm] is adjusted by, for example, the following methods.

(1) The fiber elastic modulus of the partial sheet used for the rear end part of the shaft is increased to increase the flexural rigidity value EIc.

(2) The fiber elastic modulus of the partial sheet used for the rear end part of the shaft is decreased to decrease the flexural rigidity value EIc.

(3) The amount (thickness) of the partial sheet used for the rear end part of the shaft is increased to increase the flexural rigidity value EIc.

(4) The amount (thickness) of the partial sheet used for the rear end part of the shaft is decreased to decrease the flexural rigidity value EIc.

(5) The outer diameter of the mandrel in the thinnest part is adjusted.

(6) The outer diameter of the mandrel at the point which is 175 mm from the rear end of the shaft is adjusted.

(7) The fiber elastic modulus of the prepreg used for the thinnest part of the shaft is decreased to decrease the flexural rigidity value EIm.

(8) The fiber elastic modulus of the prepreg used for the thinnest part of the shaft is increased to increase the flexural rigidity value EIm.

A flexural rigidity value (EI) can be generally calculated by the product of an elastic modulus E and cross-sectional secondary moment I. The cross-sectional secondary moment I of a circular tubular body is represented by $\pi(ds^4-dn^4)/64$. Herein, ds represents an outer diameter and dn represents an inner diameter. The flexural rigidity value can be adjusted by considering them.

In light of setting the rigidity of the rear end side lower than that of the central point of the shaft to increase the flexure, the axial distance between the first position P1 and the tip Tp of the shaft is preferably 50% of the full length of the shaft, more preferably 55%, and still more preferably 60%. In light of increasing the flexural rigidity of the rear end part of the shaft to tend to generate the release of the flexure, the axial distance between the second position P2 and the tip Tp of the shaft is preferably 75% of the full length of the shaft, more preferably 70%, and still more preferably 65%.

When the excessive flexure is generated, the shaft is hardly released. In light of the easy release of the flexure, the flexural rigidity value EIm of the thinnest part is preferably equal to or greater than 30 ($N \cdot m^2$), and more preferably equal to or greater than 35 ($N \cdot m^2$). In light of increasing the flexure, the flexural rigidity value EIm is preferably equal to or less than 60 ($N \cdot m^2$), and more preferably equal to or less than 50 ($N \cdot m^2$).

In light of facilitating the release of the flexure, the flexural rigidity value EIc is preferably equal to or greater than 60 ($N \cdot m^2$), and more preferably equal to or greater than 65 ($N \cdot m^2$). In light of suppressing the excessive release of the flexure to enhance the directivity of hit balls, the flexural rigidity value EIc is preferably equal to or less than 100 ($N \cdot m^2$), more preferably equal to or less than 90 ($N \cdot m^2$) or less, and still more preferably equal to or less than 85 ($N \cdot m^2$).

A shaft having a small flex point ratio C1 may be referred to as "a high flex point". The rear end side (hand side) of this shaft tends to easily flex. When the rear end side (hand side) easily flexes, the distance between a point at which the shaft easily flexes and the head is large. The large distance provides a large flexure amount. At the same time, the large flexure is hardly released. The flexure amount of the shaft having a small flex point ratio C1 tends to be increased. However, the release of the flexure is less likely to be generated.

It turned out that the present invention can provide the proper release of the flexure while reducing the value of the flex point ratio C1. It turned out that the present invention can maintain the flexure amount as the advantage of the shaft having the small flex point ratio C1. Furthermore, it turned out that the present invention can attain the easy release of the flexure although the flex point ratio C1 is small. That is, the present invention can effectively eliminate the disadvantage of the shaft of the high flex point. From this viewpoint, the effect of the present invention can be actualized when the flex point ratio C1 is small. Therefore, the flex point ratio C1 is preferably equal to or less than 47%. The thinnest part is disposed at a position where the release of the flexure is less likely to be decreased on a rear end side relative to the longitudinal center of the shaft. This position set of the thinnest part can reduce the value of the flex point ratio C1 and provide the proper release of the flexure. It turned out that this proper release of the flexure can be realized by the value of [EIc/EIm].

The lower limit value of the flex point ratio C1 is not limited. In light of the release of the flexure, the flex point ratio C1 is preferably equal to or greater than 40%.

The length L1 of the shaft is not limited. In light of easy swing for grown-up golf players, the length L1 is preferably 762 mm or longer and 1219 mm or shorter. The present invention can exhibit a large effect in a shaft for a wood type golf club of which particularly required flight distance and directivity. From this viewpoint, the length L1 is preferably equal to or longer than 965 mm, and more preferably equal to or longer than 1067 mm. When the shaft is too long, the probability of nice shots is apt to be reduced. From this viewpoint, the length L1 is preferably equal to or shorter than 1219 mm, more preferably equal to or shorter than 1194 mm, and still more preferably equal to or shorter than 1168 mm.

When the weight of the shaft is too light, the shaft flex is soft, and thus the release of the flexure is less likely to be attained. From this viewpoint, the weight of the shaft is preferably equal to or greater than 50 g, and more preferably equal to or greater than 52 g. In light of enhancing the operability of the golf club, the weight of the shaft is preferably equal to or less than 70 g, and more preferably equal to or less than 68 g.

EXAMPLES

Hereinafter, the effects of the present invention will be clarified by Examples. However, the present invention should not be interpreted in a limited way based on the description of Examples.

Example 1

A shaft was produced by a sheet winding method. A plurality of prepregs were wrapped around a metal mandrel to be laminated. The developed view of the laminated prepregs is shown in FIG. 3. Nine prepregs were wrapped around the mandrel (not shown) in order of a prepreg s1, a prepreg s2, . . . , a prepreg s9. The prepreg shown on a higher side in FIG. 3 was laminated on the inner side.

The prepreg s1 is a layer which reinforces a tip part of the shaft. In the prepreg s1, the orientation angle of a fiber is substantially 0 degree to the axial line of the shaft. That is, the prepreg s1 constitutes a straight layer. The prepreg s2 is provided over the full length of the shaft. The prepreg s2 is so-called a bias layer. In the prepreg s2, the orientation angle of a fiber is substantially −45 degrees to the axial line of the shaft. A prepreg s3 is also provided over the full length of the shaft. The prepreg s3 is so-called a bias layer. In the prepreg s3, the orientation angle of a fiber is substantially +45 degrees to the axial line of the shaft. The prepreg s2 and the prepreg s3 are wrapped in a state where the prepreg s2 and the prepreg s3 are overlapped with each other. When the prepreg s2 and the prepreg s3 are overlapped, the prepreg s3 is turned over from the state of FIG. 3. Thereby, the fiber orientation angles of the prepreg s2 and prepreg s3 are opposite to each other. A prepreg s4 is a full length sheet. In the prepreg s4, the orientation angle of a fiber is substantially 0 degree to the axial line of the shaft. That is, the prepreg s4 constitutes a straight layer. A prepreg s5 is a partial sheet. The prepreg s5 constitutes a layer which reinforces a rear end part. In the prepreg s5, the orientation angle of a fiber is substantially 0 degree to the axial line of the shaft. That is, the prepreg s5 constitutes a straight layer. A prepreg s6 is a partial sheet. The prepreg s6 constitutes a layer which reinforces the tip part of the shaft. In the prepreg s6, the orientation angle of a fiber is substantially 0 degree to the axial line of the shaft. That is, the prepreg s6 constitutes a straight layer. A prepreg s7 is provided over the full length of the shaft. In the prepreg s7, the orientation angle of a fiber is substantially 0 degree to the axial line of the shaft. That is, the prepreg s7 constitutes a straight layer. A prepreg s8 constitutes a layer which reinforces the tip part. In the prepreg s8, the orientation angle of a fiber is substantially 0 degree to the axial line of the shaft. That is, the prepreg s8 constitutes a straight layer. The prepreg s9 constitutes a layer which reinforces the tip part. In the prepreg s9, the orientation angle of a fiber is substantially 0 degree to the axial line of the shaft. That is, the prepreg s9 constitutes a straight layer. The sizes of the prepregs s1 to s9 are as shown in FIG. 3. The unit of the size is mm. The sizes of the prepregs are shown by double-pointed arrows also in FIGS. 4, 5 and 6 to be described later. The units of these sizes are mm.

The variety names (product names) of the prepregs used for the prepregs s1 to s9 are shown in the following Table 1. Each of varieties shown in Table 1 is a prepreg produced by MITSUBISHI RAYON CO., LTD. In all the varieties shown in Table 1, a matrix resin is an epoxy resin. All the varieties shown in Table 2, 3 and 4 are also prepregs produced by MITSUBISHI RAYON CO., LTD. In all the varieties shown in Table 2, 3 and 4, a matrix resin is an epoxy resin.

A tape made of polypropylene was wrapped around outside the laminate around which nine prepregs were wound. This was heated and pressurized in an oven to produce a formed body while curing the resin. The mandrel was extracted from the formed body taken out from the oven. The both end parts of the formed body were cut in order to align the length, and the formed body was subjected to surface polishing to obtain a shaft according to Example 1. The shaft was subjected to surface polishing by using a polishing paper type polishing device so as that a point separated by 720 mm from the tip Tp of the shaft was a thinnest part. A head and a grip were mounted to this shaft to obtain a golf club. As the head, "SRIXON ZR-700, loft: 9.5 degrees" produced by SRI Sports Limited was used. The length of the club was set to be 45 inches, and the balance of the club (swing weight) was set to D2.

Example 2

The developed view of a shaft of Example 2 is shown in FIG. 4. In Example 2, nine prepregs e1 to e9 were used. The varieties of the prepregs of Example 2 are shown in Table 2. A shaft and a golf club according to Example 2 were obtained in the same manner as in Example 1 except that the compositions of the prepregs shown in FIG. 4 and Table 2 were used. Even in Example 2, the shaft was subjected to surface polishing so as that a point separated by 720 mm from a tip Tp of the shaft was a thinnest part.

Comparative Example 3

The developed view of a shaft of Comparative Example 3 is shown in FIG. 4. In Comparative Example 3, nine prepregs e1 to e9 were used. The varieties of the prepregs of Comparative Example 3 are shown in Table 2. The difference between Comparative Example 3 and Example 2 is only the surface polishing. In Comparative Example 3, a shaft and a golf club according to Comparative Example 3 were obtained in the same manner as in Example 2 except that the shaft was subjected to surface polishing so as that a point separated by 520 mm from a tip Tp was a thinnest part.

Comparative Example 4

The developed view of a shaft of Comparative Example 4 is shown in FIG. 5. In Comparative Example 4, eight prepregs f1 to f8 were used. The varieties of the prepregs of Comparative Example 4 are shown in Table 3. In Comparative Example 4, a shaft and a golf club according to Comparative Example 4 were obtained in the same manner as in Example 1 except that the shaft was subjected to surface polishing so as that the polishing amount is substantially uniformed over the full length of the shaft.

Comparative Example 5

The developed view of a shaft of Comparative Example 5 is shown in FIG. 6. In Comparative Example 5, eight prepregs g1 to g8 were used. The varieties of the prepregs of Comparative Example 5 are shown in Table 4. In Comparative Example 5, a shaft and a golf club according to Comparative Example 5 were obtained in the same manner as in Example 1 except that the shaft was subjected to surface polishing so that the polishing amount is substantially uniformed over the full length of the shaft.

In Examples 1 and 2 described above, a time to bring the shaft into contact with an abradant (whetstone) was varied depending on the longitudinal position of the shaft if needed to partially adjust the polishing amount. In Examples 1 and 2 described above, the polishing amount Km in the thinnest part was set larger than the minimum polishing amount Ks.

TABLE 1

Prepreg specifications of Example 1

| | Prepreg kind | Fiber orientation angle | Type |
|---|---|---|---|
| s1 | TR350C-100S | 0° | Tip part reinforcing layer |
| s2 | HRX350C-110S | −45° | Full length layer |
| s3 | HRX350C-110S | +45° | Full length layer |
| s4 | MR350C-125S | 0° | Full length layer |
| s5 | HRX350C-130S | 0° | Rear end part reinforcing layer |
| s6 | MR350C-100S | 0° | Tip part reinforcing layer |
| s7 | MR350C-150S | 0° | Full length layer |
| s8 | TR350C-100S | 0° | Tip part reinforcing layer |
| s9 | TR350C-100S | 0° | Tip part reinforcing layer |

TABLE 2

Prepreg specifications of Example 2 and Comparative Example 3

| | Prepreg kind | Fiber orientation angle | Type |
|---|---|---|---|
| e1 | TR350C-100S | 0° | Tip part reinforcing layer |
| e2 | HRX350C-110S | −45° | Full length layer |
| e3 | HRX350C-110S | +45° | Full length layer |
| e4 | MR350C-125S | 0° | Full length layer |
| e5 | HRX350C-110S | 0° | Rear end part reinforcing layer |
| e6 | MR350C-100S | 0° | Tip part reinforcing layer |
| e7 | MR350C-150S | 0° | Full length layer |
| e8 | TR350C-100S | 0° | Tip part reinforcing layer |
| e9 | TR350C-100S | 0° | Tip part reinforcing layer |

TABLE 3

Prepreg specifications of Comparative Example 4

| | Prepreg kind | Fiber orientation angle | Type |
|---|---|---|---|
| f1 | TR350C-100S | 0° | Tip part reinforcing layer |
| f2 | HRX350C-110S | −45° | Full length layer |
| f3 | HRX350C-110S | +45° | Full length layer |
| f4 | MR350C-150S | 0° | Full length layer |
| f5 | MR350C-100S | 0° | Tip part reinforcing layer |
| f6 | MR350C-150S | 0° | Full length layer |
| f7 | TR350C-100S | 0° | Tip part reinforcing layer |
| f8 | TR350C-100S | 0° | Tip part reinforcing layer |

TABLE 4

Prepreg specifications of Comparative Example 5

| | Prepreg kind | Fiber orientation angle | Type |
|---|---|---|---|
| g1 | TR350C-100S | 0° | Tip part reinforcing layer |
| g2 | HRX350C-110S | −45° | Full length layer |
| g3 | HRX350C-110S | +45° | Full length layer |
| g4 | MR350C-125S | 0° | Full length layer |
| g5 | MR350C-100S | 0° | Rear end part reinforcing layer |
| g6 | MR350C-150S | 0° | Full length layer |
| g7 | TR350C-100S | 0° | Tip part reinforcing layer |
| g8 | TR350C-100S | 0° | Tip part reinforcing layer |

[Method for Measuring Flexural Rigidity EI]

Figure 7:
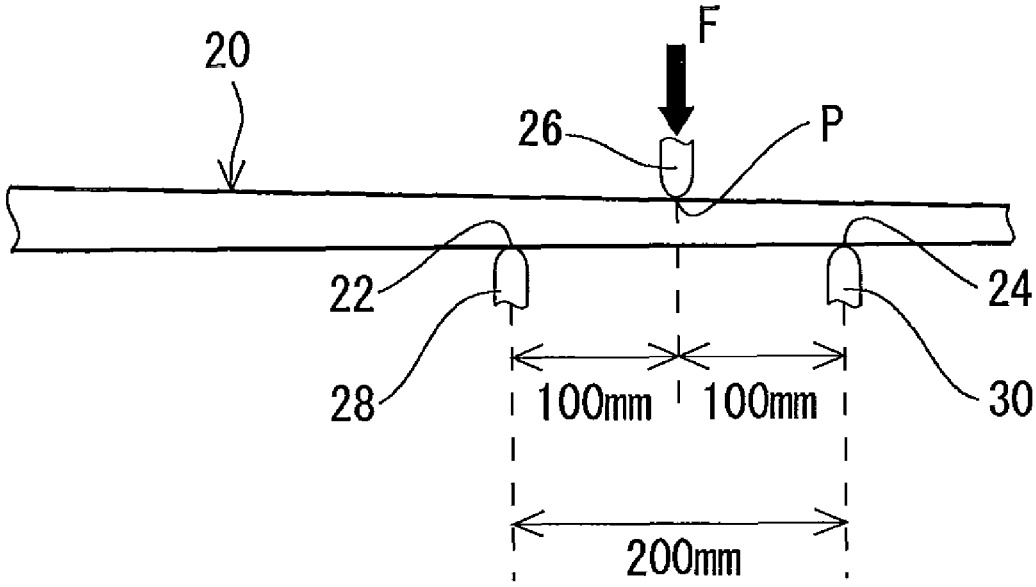
FIG. 7 shows a method for measuring flexural rigidity (EI)

FIG. 7 shows an explanatory view for illustrating the method for measuring the flexural rigidity EI. The flexural rigidity EI was measured using type 2020 produced by INTESCO co., ltd. (maximum load: 500 kg). As shown in FIG. 7, deflection a was measured when a load F was applied to a measurement point P from above while supporting a shaft 20 from beneath at two supporting points 22 and 24. A distance (span) between the supporting point 22 and the supporting point 24 was 200 mm. The measurement point P was located at a point provided by equally dividing the length between the supporting point 22 and the supporting point 24. The tip of an indenter 26 that applies the load F from above is rounded. The cross-sectional shape of the tip of the indenter 26 has a curvature radius of 10 mm in the cross section which is parallel to the axial direction of the shaft. In the cross section which is perpendicular to the axial direction of the shaft, the cross-sectional shape of the tip of the indenter 26 has a linear shape, and the length thereof is 45 mm.

By a support 28, the shaft 20 is supported from beneath at the supporting point 22. The tip of the support 28 has a protruded round shape. The cross-sectional shape of the tip of the support 28 has a curvature radius of 15 mm in the cross section which is parallel to the axial direction of the shaft. In the cross section which is perpendicular to the axial direction of the shaft, the cross-sectional shape of the tip of the support 28 has a linear shape, and the length thereof is 50 mm. A support 30 has a shape which is the same as that of the support 28. By the support 30, the shaft 20 is supported from beneath at the supporting point 24. The tip of the support 30 has a protruded round shape. The cross-sectional shape of the tip of the support 30 has a curvature radius of 15 mm in the cross section which is parallel to the axial direction of the shaft. In the cross section which is perpendicular to the axial direction of the shaft, the cross-sectional shape of the tip of the support 30 has a linear shape, and the length thereof is 50 mm.

The indenter 26 was moved downward at a rate of 5 mm/min while fixing the support 28 and the support 30. When the load F reached 20 kg, the movement of the indenter 26 was terminated. Deflection $\alpha$ (mm) of the shaft 20 at a moment when the movement of the indenter 26 was terminated was measured. The flexural rigidity EI ($N \cdot m^2$) was calculated according to the following formula.

$$EI(N \cdot m^2) = 32.7/\alpha$$

[Measurement of Forward Flex F1]

Figure 8A:
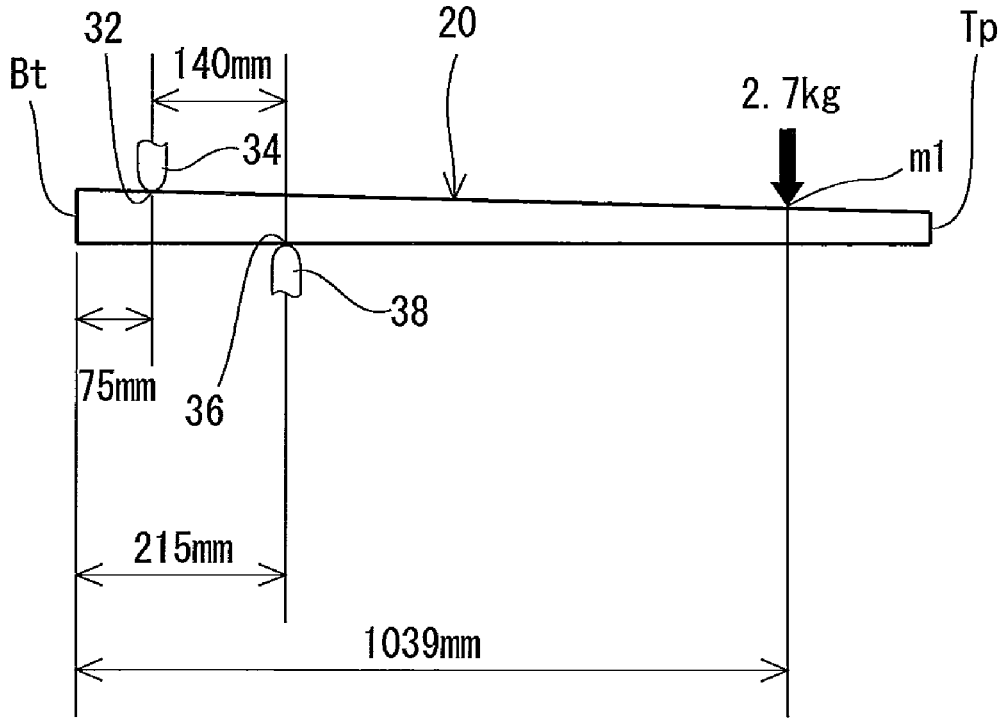
FIG. 8A shows a method for measuring forward flex.

FIG. 8A shows an explanatory view for illustrating the method for measuring the forward flex F1. As shown in FIG. 8A, a first supporting point 32 was set at a position which is 75 mm away from the rear end Bt of the shaft. Further, a second supporting point 36 was set at a position which is 215 mm away from the rear end Bt of the shaft. At the first supporting point 32, a support 34 supporting the shaft 20 from above was provided. At the second supporting point 36, a support 38 supporting the shaft 20 from beneath was provided. In the state in which there is no load, the shaft axial line of the shaft 20 was substantially horizontal. At a weight point m1 which is positioned 1039 mm away from the rear end Bt of the shaft, a load of 2.7 kg was allowed to act in a vertical downward direction. A travel distance (mm) of the weight point m1 from the state in which there was no load to the state in which a load was applied was determined as the forward flex F1. This travel distance is a distance of the movement along the vertical direction.

The cross-sectional shape of a part of the support 34 to be brought into contact with the shaft (hereinafter, referred to as contact part) is as in the following. In a cross section which is parallel to the axial direction of the shaft, cross-sectional shape of the contact part of the support 34 has a protruded round shape. The curvature radius of this roundness is 15 mm. In a cross section which is perpendicular to the axial direction of the shaft, the cross-sectional shape of the contact part of the support 34 has a recessed round shape. The curvature radius of this roundness is 40 mm. In the cross section which is perpendicular to the axial direction of the shaft, the length of the contact part of the support 34 in the horizontal direction (length in the depth direction in FIG. 8) is 15 mm. The cross-sectional shape of the contact part of the support 38 is the same as that of the support 34. The cross-sectional shape of the contact part of the load indenter (not shown in the figure) which applies a load of 2.7 kg at the point m1 has a protruded roundness in the cross section which is parallel to the axial direction of the shaft. The curvature radius of this roundness is 10 mm. Cross-sectional shape of the contact part of the load indenter (not shown in the figure) which applies a load of 2.7 kg at the point m1 is linear in the cross section which is perpendicular to the axial direction of the shaft. This line has a length of 18 mm. Accordingly, the forward flex F1 was measured.

[Measurement of Backward Flex F2]

Figure 8B:
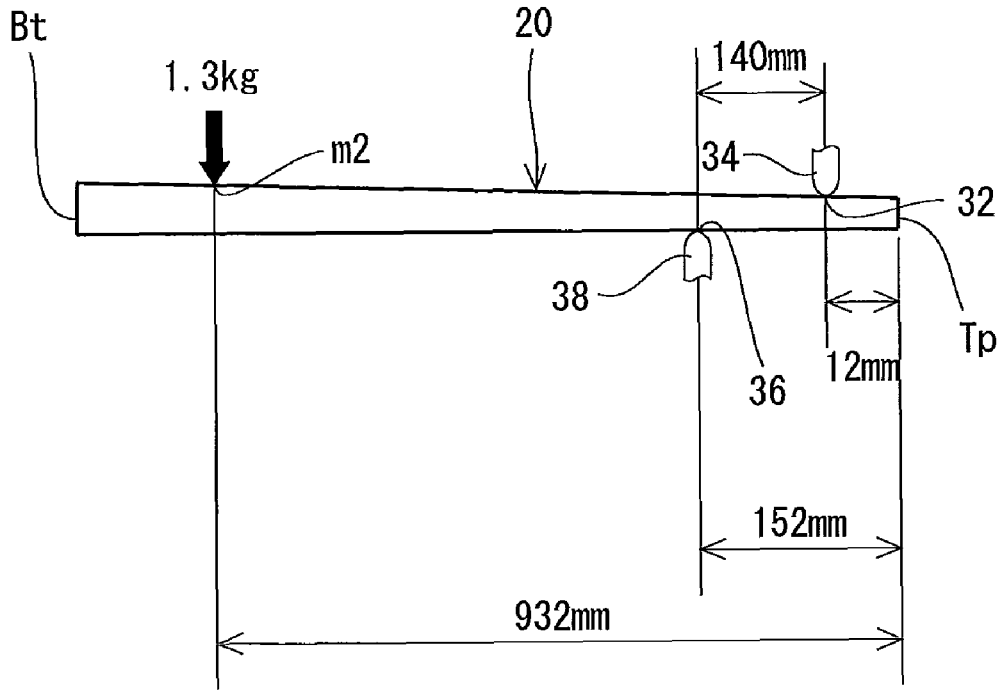
FIG. 8B shows a method for measuring backward flex.

The method for measuring the backward flex is shown in FIG. 8B. The backward flex F2 was measured in the similar manner as in the forward flex F1 except that the first supporting point 32 was set at a position which was 12 mm away from the tip Tp of the shaft; the second supporting point 36 was set at a position which was 152 mm away from the tip Tp of the shaft; the weight point m2 was set at a position which was 932 mm away from the tip Tp of the shaft; and a load of 1.3 kg was employed.

Figure 9:
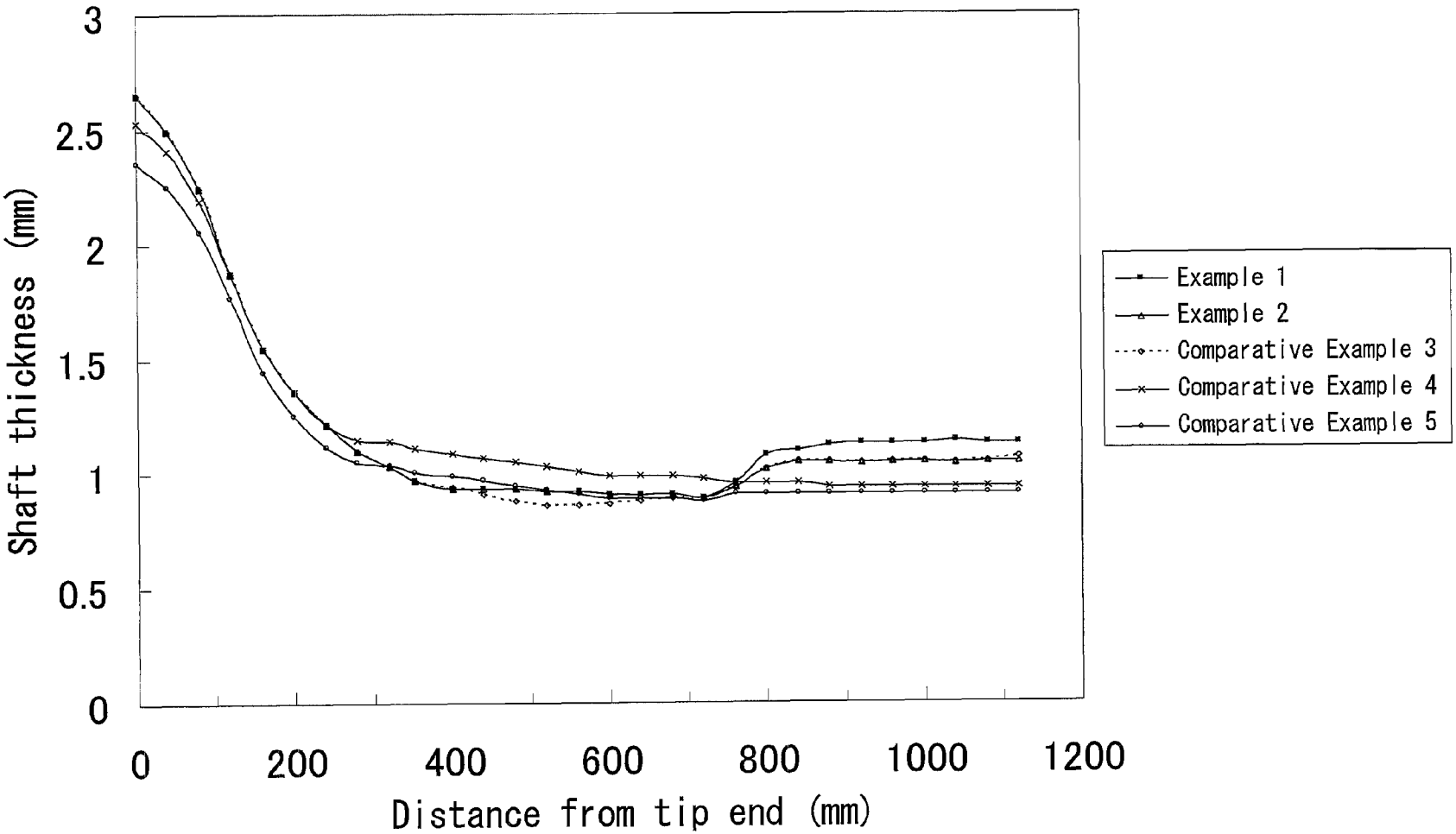
FIG. 9 is a graph showing the thickness distribution of each of shafts of Examples and Comparative Examples.
Figure 10:
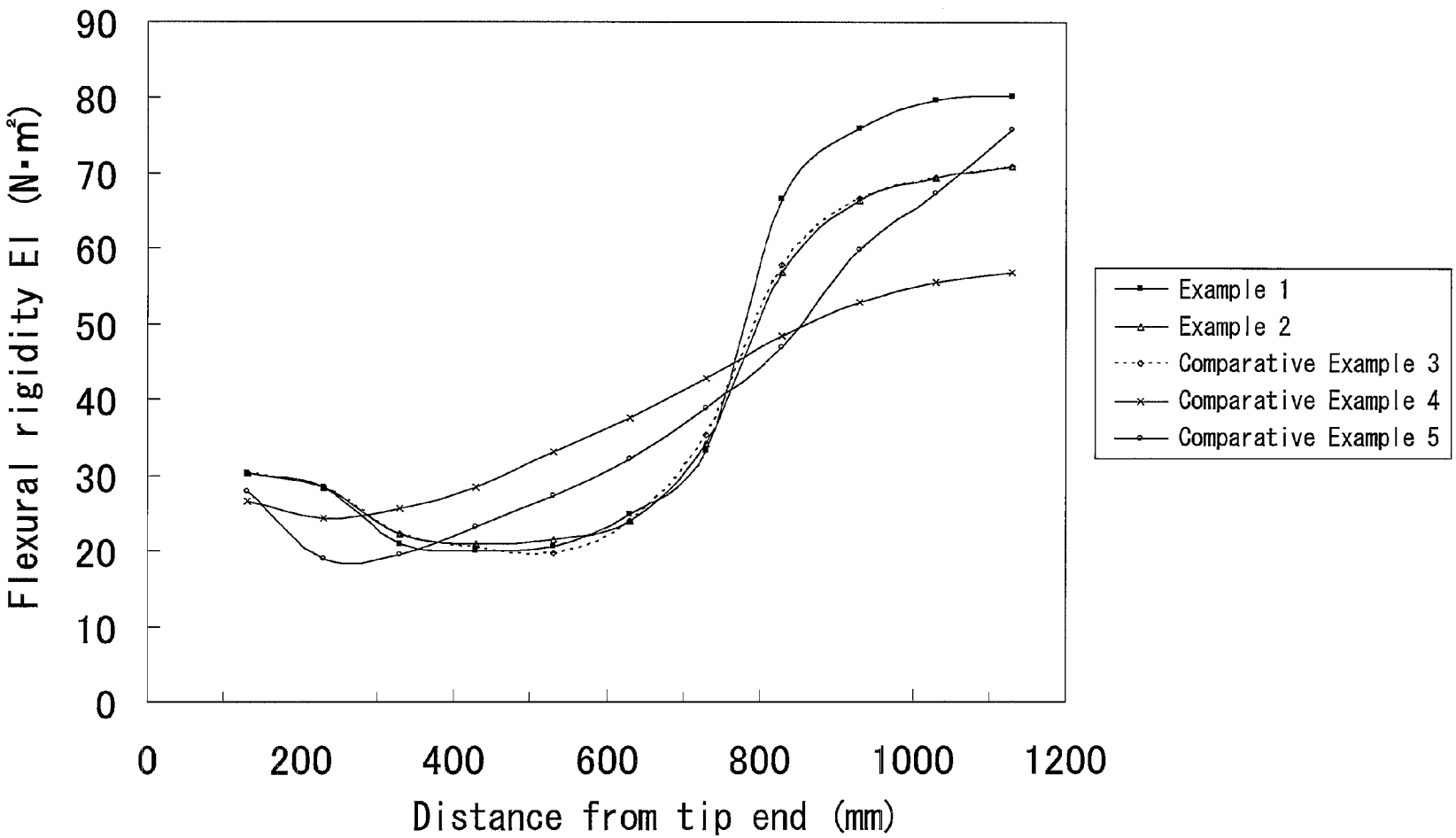
FIG. 10 is a graph showing the flexural rigidity distribution of each of the shafts of Examples and Comparative Examples.

The specifications of Examples and Comparative Examples are shown in the following Table 5. FIG. 9 is a graph showing the thicknesses of the shafts of Examples and Comparative Examples. FIG. 10 is a graph showing flexural rigidity distributions of Examples and Comparative Examples. In the graphs of FIGS. 9 and 10, the plotted points are measured values. A curve which connects the plotted points is drawn based on the calculated values. These calculated values were calculated based on the outer diameter of the mandrel, the thickness of the laminated prepregs, the polishing amount, and the measured values of the plotted points.

TABLE 5

Shaft specifications of Examples and Comparative Examples

| | Shaft length L1 mm | Shaft weight g | Torque deg | Forward flex F1 mm | Backward flex F2 mm | Flex point ratio C1 % | Distance Ds between thinnest part and tip mm | 100 × (Ds/L1) % | Thickness Tm of thinnest part Tm mm | Thickness Tc of Pc point Tc mm | Tc/Tm | Flexural rigidity of thinnest part EIm N · m$^2$ | Flexural rigidity of Pc point EIc N · m$^2$ | EIc/EIm |
|---|---|---|---|---|---|---|---|---|---|---|---|---|---|---|
| Example 1 | 1168 | 65.0 | 3.5 | 100 | 85 | 45.95 | 725 | 62.1 | 0.89 | 1.13 | 1.27 | 33.2 | 80.2 | 2.42 |
| Example 2 | 1168 | 64.9 | 3.5 | 100 | 87 | 46.52 | 720 | 61.6 | 0.89 | 1.06 | 1.19 | 34.8 | 69.8 | 2.01 |
| Comparative Example 3 | 1168 | 65.3 | 3.5 | 100 | 88 | 46.81 | 525 | 44.9 | 0.86 | 1.08 | 1.26 | 19.8 | 69.7 | 3.52 |
| Comparative Example 4 | 1168 | 65.0 | 3.5 | 100 | 87 | 46.52 | 1100 | 94.2 | 0.94 | 0.94 | 1.00 | 66.2 | 65.2 | 0.98 |
| Comparative Example 5 | 1168 | 65.2 | 3.5 | 100 | 102 | 50.5 | 730 | 62.5 | 0.88 | 0.91 | 1.03 | 43.0 | 54.7 | 1.27 |

[Evaluation by Tester]

Ten testers hit 10 golf balls by each golf club, and the flight distance of each of hit balls was measured. The head speeds of ten testers on using a driver are in the range of about 38 (m/s) to 51 (m/s). As the golf ball, "SRIXON Z-UR" (registered trade name) produced by SRI Sports Limited was used. "SRIXON Z-UR" is a three-piece solid golf ball. The measured items are as follows.

(1) Head speed
(2) Loft angle at impact
(3) Launch angle
(4) Carry flight distance
(5) Run
(6) Total distance
(7) Horizontal displacement The "loft angle at impact" is a loft angle to the vertical direction at the moment of impact. The "loft angle at impact" was obtained by analyzing an image obtained by photographing the moment of impact. The carry flight distance is a flight distance between the position where the ball was hit and the position where the ball dropped first. The total distance is a flight distance between the position where the ball was hit and the position where the ball finally stopped. The "horizontal displacement" is a displacement distance relative to the target direction. A displacement distance when the ball is shifted to the right was defined as a plus value, and a displacement distance when the ball was shifted to the left is defined as a minus value. The "horizontal displacement" was measured based on the position where the ball finally stopped. The lower the absolute value of the "horizontal displacement" is, the better the "horizontal displacement" is. A total of hundred data were averaged for each of data. This average value is shown in the following Table 6.

As shown in Table 6, Examples provide higher evaluations than those of Comparative Examples. The prepreg constitution of Example 2 is the same as that of Comparative Example 3. However, the position of the thinnest part is different between Example 2 and Comparative Example 3 depending on polishing. Since the thinnest part is near the tip in Comparative Example 3, the flexure amount of Comparative Example 3 is less than that of Example 2. Therefore, the head speed and flight distance of Comparative Example 3 are smaller than those of Example 2. Since [EIc/EIm] is small in Comparative Example 4, the release of the shaft is small and the golf ball is shot to the right relative to the target. Since the position of the thinnest part is excessively near the rear end in Comparative Example 4, the release of the flexure is small. Since a flex point ratio C1 is large in Comparative Example 5, the directivity of Comparative Example 5 is deteriorated. Since a flex point ratio C1 is large in Comparative Example 5, the flexure amount is small, and the head speed and the flight distance are small. Comparative Example 5 shows the feature of the shaft of the low flex point. The large head speeds of Examples 1 and 2 are caused by the large flexure amount. The results of Examples 1 and 2 show that the release of the flexure is good although the shaft of Examples 1 and 2 are the shaft of the high flex point. Advantages of the present invention are clearly indicated by these results of evaluation.

The shaft of the present invention is applicable to all types of golf clubs such as wood type golf clubs and iron golf clubs or the like.

The description hereinabove is merely for an illustrative example, and various modifications can be made in the scope not to deviate from the principles of the present invention.

TABLE 6

Results of evaluation of Examples and Comparative Examples

| | Unit | Example 1 | Example 2 | Comparative Example 3 | Comparative Example 4 | Comparative Example 5 |
|---|---|---|---|---|---|---|
| Head speed | m/s | 45.6 | 45.4 | 45.2 | 45.1 | 44.8 |
| Loft angle at impact | deg | 16.1 | 15.4 | 14.2 | 13.8 | 16.3 |
| Launch angle | deg | 14.8 | 13.6 | 12.5 | 11.2 | 14.7 |
| Carry flight distance | Yard | 229.0 | 227.7 | 223.8 | 222.3 | 223.5 |
| Run | Yard | 7.8 | 9.8 | 10.0 | 11.2 | 6.1 |
| Total distance | Yard | 236.8 | 237.5 | 233.8 | 233.5 | 229.6 |
| Horizontal displacement | Yard | −3.2 | −1.2 | −1.7 | +5.4 | −11.8 |

What is claimed is:

1. A golf club shaft being a tubular body, comprising a laminate of fiber reinforced resin layers, wherein each of the fiber reinforced resin layers comprises a matrix resin and a fiber;

when a portion with a most minimum thickness in the entire shaft is defined as a thinnest part, the entire thinnest part exists in a range of a first position to a second position;

the first position is a position where an axial distance from a tip of the shaft is 50% of a full length of the shaft;

the second position is a position where the axial distance from the tip of the shaft is 75% of the full length of the shaft; and a flexural rigidity value EIc ($N/m^2$) of the shaft at a point which is 175 mm away from a rear end of the shaft is two times or greater and three times or less of a flexural rigidity value EIm ($N/m^2$) of the thinnest part and wherein there is no other portion of the shaft outside the range of the first portion to the second portion which has a thickness equal to or less then the most minimum thickness of the entire shaft.

2. The golf club shaft according to claim 1, wherein a flex point ratio C1 of the shaft defined by the following formula is equal to or less than 47%, $$C1=[F2/(F1+F2)]\times 100$$

wherein F1 is forward flex (mm), and F2 is backward flex (mm).

3. The golf club shaft according to claim 1, wherein the shaft is subjected to surface polishing; and when a polishing amount (mm) in a portion where the polishing amount is minimum in the entire shaft is defined as Ks and a polishing amount (mm) in the thinnest part is defined as Km, the polishing amount Km is larger than the polishing amount Ks.

4. The golf club shaft according to claim 3, wherein the polishing amount Ks in a portion where the polishing amount is minimum in the entire shaft is 0.01 mm or greater and 0.08 mm or less.

5. The golf club shaft according to claim 3, wherein the polishing amount Km (mm) in the thinnest part is 0.02 mm or greater and 0.13 mm or less.

6. The golf club shaft according to claim 1, wherein a thickness Tm of the thinnest part is 0.6 mm or greater and 1.5 mm or less.

7. The golf club shaft according to claim 1, wherein the flexural rigidity value EIm of the thinnest part is 30 ($N\cdot m^2$) or greater and 60 ($N\cdot m^2$) or less.

8. The golf club shaft according to claim 1, wherein an axial length of the thinnest part is equal to or shorter than 50 mm.

9. The golf club shaft according to claim 1, wherein the shaft is subjected to surface polishing; and when a polishing amount (mm) in a portion where the polishing amount is minimum in the entire shaft is defined as Ks and a polishing amount (mm) in the thinnest part is defined as Km, a difference (Km−Ks) is 0.01 mm or greater and 0.1 mm or less.

10. The golf club shaft according to claim 1, wherein the shaft is subjected to surface polishing; and a polishing amount Ks in a portion where the polishing amount is minimum in the entire shaft is 0.01 mm or greater and 0.08 mm or less.

11. The golf club shaft according to claim 1, wherein the shaft is subjected to surface polishing; and a polishing amount Km (mm) in the thinnest part is 0.02 mm or greater and 0.13 mm or less.

12. The golf club shaft according to claim 1, wherein a thickness Tc (mm) of the shaft at the point which is 175 mm away from the rear end of the shaft is 0.6 mm or greater and 2.3 mm or less.

13. The golf club shaft according to claim 1, wherein a ratio [Tc/Tm] of a thickness Tc (mm) of the shaft at the point which is 175 mm away from the rear end of the shaft to a thickness Tm of the thinnest part is 1.05 or greater and 1.5 or less.

14. The golf club shaft according to claim 1, wherein the flexural rigidity value EIc at the point which is 175 mm away from the rear end of the shaft is 60 ($N\cdot m^2$) or greater and 100 ($N\cdot m^2$) or less.

15. The golf club shaft according to claim 1, wherein a length L1 of the shaft is 762 mm or longer and 1219 mm or shorter.

16. The golf club shaft according to claim 1, wherein a weight of the shaft is 50 g or greater and 70 g or less.

* * * * *